US010330286B2

(12) United States Patent
Simms

(10) Patent No.: US 10,330,286 B2
(45) Date of Patent: Jun. 25, 2019

(54) LIGHTING DEVICE WITH A VIEWING HOLE

(71) Applicant: Kevin Simms, Fort Pierce, FL (US)

(72) Inventor: Kevin Simms, Fort Pierce, FL (US)

( * ) Notice: Subject to any disclaimer, the term of this patent is extended or adjusted under 35 U.S.C. 154(b) by 0 days.

(21) Appl. No.: 15/864,504

(22) Filed: Jan. 8, 2018

(65) Prior Publication Data

US 2018/0335199 A1 Nov. 22, 2018

Related U.S. Application Data

(60) Provisional application No. 62/509,581, filed on May 22, 2017.

(51) Int. Cl.

| | |
|---|---|
| ***F21Y 103/33*** | (2016.01) |
| ***F21Y 105/18*** | (2016.01) |
| ***F21Y 115/10*** | (2016.01) |
| ***F21L 4/00*** | (2006.01) |
| ***F21V 13/04*** | (2006.01) |
| ***F21V 7/00*** | (2006.01) |
| ***F21V 17/12*** | (2006.01) |
| ***F21V 23/06*** | (2006.01) |
| ***F21V 3/00*** | (2015.01) |
| ***F21V 5/04*** | (2006.01) |
| *F21V 23/04* | (2006.01) |
| *F21V 21/088* | (2006.01) |
| *F21W 131/411* | (2006.01) |

(52) U.S. Cl.

CPC ..... *F21V 13/045* (2013.01); *F21L 4/005* (2013.01); *F21V 3/00* (2013.01); *F21V 5/04* (2013.01); *F21V 7/00* (2013.01); *F21V 17/12* (2013.01); *F21V 23/06* (2013.01); *F21V 21/0885* (2013.01); *F21V 23/0421* (2013.01); *F21W 2131/411* (2013.01); *F21Y 2103/33* (2016.08); *F21Y 2105/18* (2016.08); *F21Y 2115/10* (2016.08)

(58) Field of Classification Search

CPC ..... F21Y 2115/10; F21Y 2107/30; F21Y 2113/13; F21Y 2113/20; F21L 4/027; F21L 4/005; F21L 4/00; F21L 14/02

USPC ..... 362/202

See application file for complete search history.

(56) References Cited

U.S. PATENT DOCUMENTS

| | | | | |
|---|---|---|---|---|
| 2,320,917 A * | 6/1943 | Ely | F21L 4/00 362/194 |
| 2002/0149930 A1* | 10/2002 | Parker | F21L 4/045 362/206 |
| 2017/0123216 A1* | 5/2017 | Hoover | F21L 4/027 |

* cited by examiner

*Primary Examiner* — William J Carter

(57) ABSTRACT

A handheld lighting device with a viewing mechanism to inspect a subject through an opening consists of a head portion, a lighting source, a handle, a power source, and a peep hole. To mimic a flashlight, the head portion is terminally connected to the handle. The lighting source is positioned within the head portion. The power source is positioned within the handle and is electrically connected to the lighting source. The peep hole traverses through the handle and the head portion. The lighting source and the power source are configured to be positioned around the peep hole. Thus, the user can utilize the peep hole to observe a viewing area illuminated by the lighting source. To maximize the range of the lighting source, a reflector is positioned within the head portion.

12 Claims, 6 Drawing Sheets

LIGHTING DEVICE WITH A VIEWING HOLE

The current application claims a priority to the U.S. Provisional Patent application Ser. No. 62/509,581 filed on May 22, 2017.

FIELD OF THE INVENTION

The present invention relates generally to handheld tools and portable flashlights. More specifically, the present invention is related to orifice inspection apparatuses.

BACKGROUND OF THE INVENTION

Construction workers and home owners often find the need to look inside an orifice on walls, ceilings, or floors to inspect for possible obstructions, damages, etc. Currently, construction workers and home owners struggle to see inside an orifice with the naked eye as the space is usually dark and with little or no ambient illumination. Trying to see inside an orifice with the help of a flashlight next to the unprotected eye usually results in the light from the flashlight hitting the eye which ends up further obstructing the view. A solution to help improve the vision inside an orifice is to make the hole bigger or remove part of the surface to look inside. However, removing parts of the surface or increasing the size of the orifice requires more tools, more time, increases the amount of debris left from the process, and sometimes is undesirable to do. Another solution to help improve the vision inside an orifice is to use a tool specialized for the purpose of looking inside an orifice, such as borescopes which use a camera connected to a telescopic arm connected to a handle and a display. However, these electronic tools are usually fragile, expensive, need to be plugged-in or recharged, and require some setup prior to use. There is a need for a cheap alternative to improve the view inside an orifice on a surface which does not obstruct the view, provides lighting while not obstructing the view, it is not fragile, it is handheld, and it does not need to be setup or plugged in during use.

An objective of the present invention is to provide an apparatus which allows the user to look straight inside an orifice with an unobstructed view. Allowing the user to look inside an orifice helps the user see clearly what is inside. Another objective of the present invention is to provide an apparatus which illuminates the view inside an orifice without obstructing the line of sight. Having an illuminated view that is not obstructed by the rays of light hitting the eye is helpful as the orifice often lacks illumination and oftentimes the small size of the orifices block the ambient light. Another objective of the present invention is to provide an apparatus which is portable and handheld. Being able to carry the apparatus anywhere is extremely useful and being able to hold the apparatus with one hand helps the user multitask and simplify their work. Another objective of the present invention is to provide an apparatus that is inexpensive and easy to use. Home owners and similar users who are not in the construction business would benefit from a cheap apparatus that can be easily used whenever the apparatus is needed so the user does not have to buy the more complex and expensive alternatives such as borescopes or infrared cameras.

Another objective of the present invention is to provide an apparatus which does not require a power source while the apparatus is used and which does not require to be recharged. Oftentimes construction workers or home owners have to look inside orifices on surface which are far from a power source, so having an apparatus which is powered by replaceable batteries is convenient and practical to use. Another objective of the present invention is to provide an apparatus with a vision enhancer, such as a magnifying lens. It is useful to clearly see small details such as cracks or rust inside an orifice, so having a magnifying lens on the apparatus makes the apparatus more useful to construction workers and home owners. Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention.

The present invention introduces a lighting device that can be used with an orifice. The effective design of the present invention allows a desired viewing area to be inspected through a peep hole without causing any damage to the surface the orifice traverses through. As an example, if the present invention is being used with an orifice that traverses through a wall, the desired viewing area on the opposite side of the wall can be inspected without causing any damage to the wall. Moreover, by utilizing the present invention, the desired area can be inspected regardless of the lighting conditions.

Figure 1:
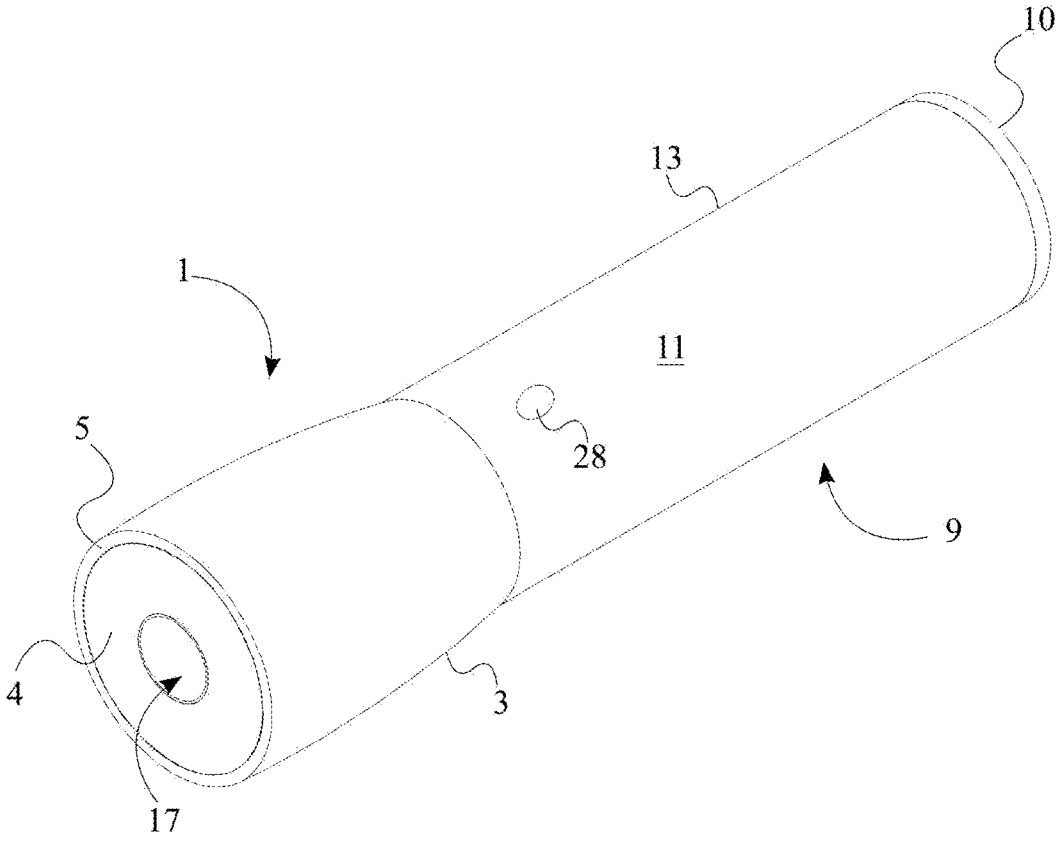
FIG. 1 is a perspective view of the present invention.
Figure 2A:
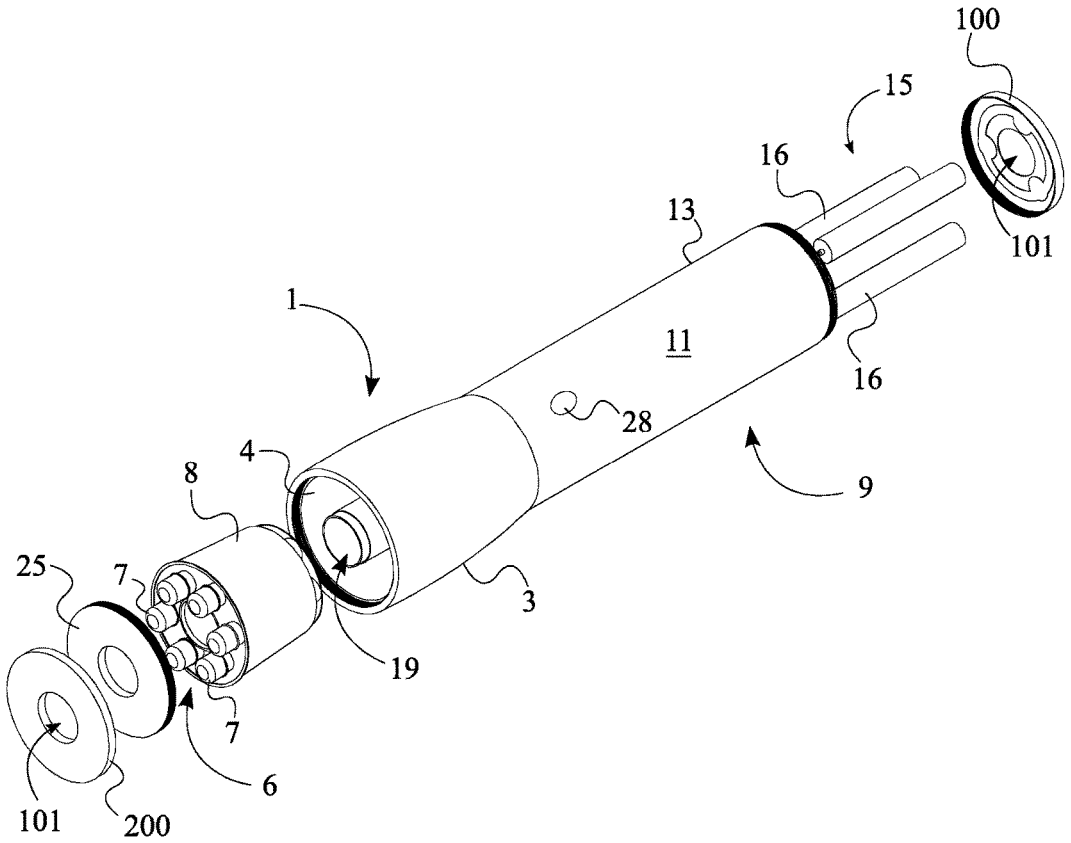
FIG. 2A is a perspective exploded view of the present invention.
Figure 2B:
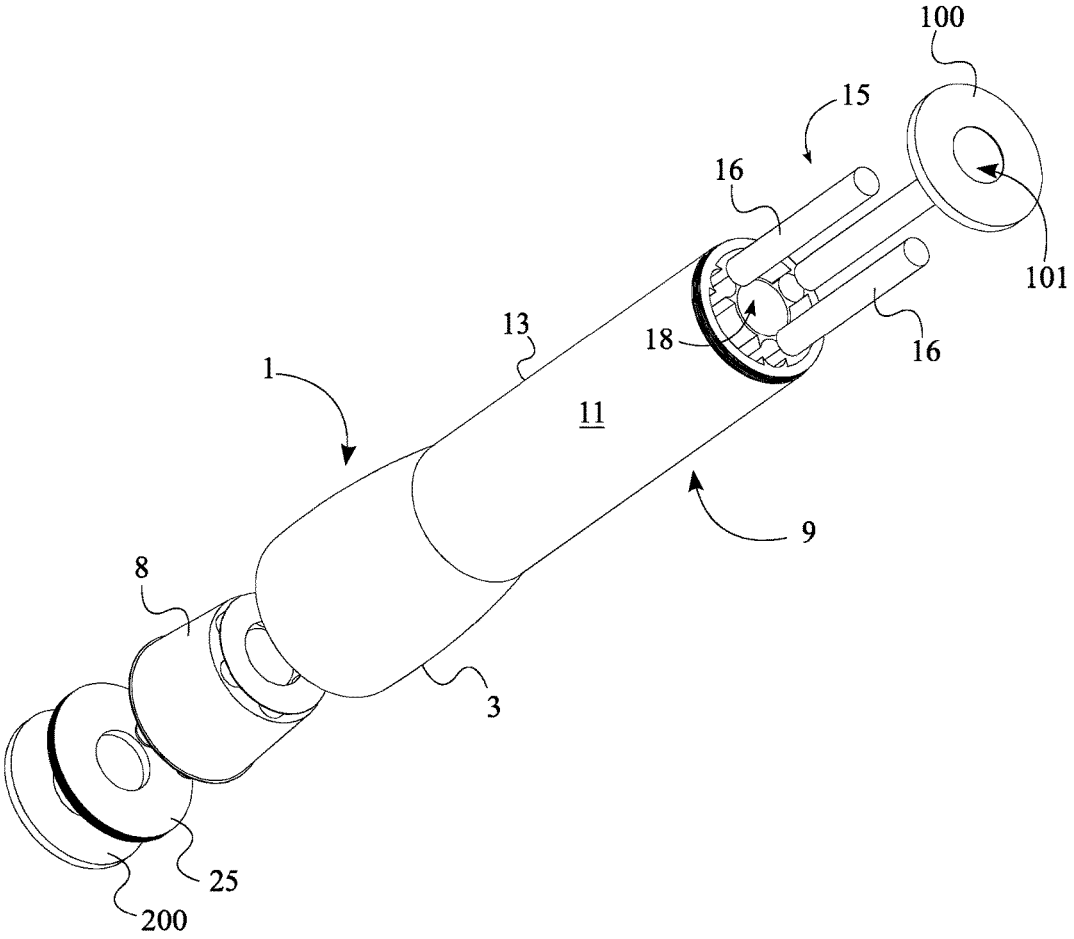
FIG. 2B is another perspective exploded view of the present invention.

As seen in FIG. 1, FIG. 2A, and FIG. 2B, to achieve the intended functionalities, the present invention comprises a head portion 1, a lighting source 6, a handle 9, a power source 15, and a peep hole 17. The head portion 1 and the handle 9 construct the structural body of the present invention and are designed to mimic a flashlight. Thus, the handle 9 is terminally connected to the head portion 1. The size and shape of the head portion 1 and the handle 9 can vary in different embodiments of the present invention. The material used to manufacture the handle 9 and the head portion 1 can also vary in different embodiments of the present invention.

When the present invention is used to inspect a desired viewing area through an opening of a surface, the lighting source 6 is used to illuminate the desired viewing area in low light conditions. To do so, the lighting source 6 is electrically connected to the power source 15 and is positioned within the head portion 1. On the other hand, the power source 15 is positioned within the handle 9. The electrical connection between the lighting source 6 and the power source 15 can be established through a lighting printed circuit board (PCB) and a switching PCB. Thus, when the head portion 1 is positioned adjacent the opening, the light from the lighting source 6 is transmitted onto the desired viewing area through the opening the present invention is being used with. The performance characteristics and other properties of both the lighting source 6 and the power source 15 can vary from one embodiment to another. As an example, the wattage of the lighting source 6 can vary in different embodiments of the present invention. The voltage of the power source 15 can also vary in different embodiments of the present invention.

Figure 3:
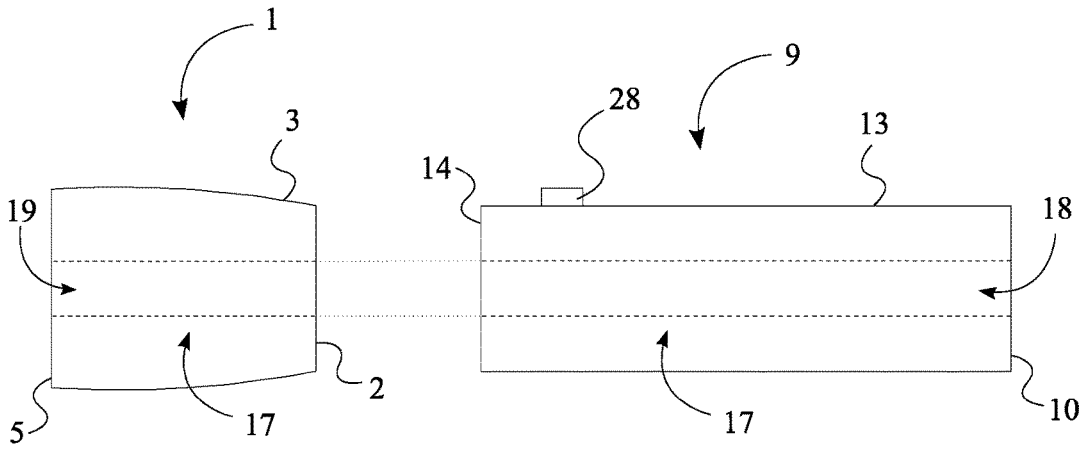
FIG. 3 is a side view of the head portion and the handle, wherein the head traversing portion and the handle traversing portion are illustrated.

The peep hole 17 is used to inspect the desired viewing area when the desired viewing area is illuminated by the lighting source 6. The desired viewing area can vary based upon the industry the present invention is being used in. As an example, the desired viewing area for an electrician is different from the desired viewing area for a construction worker. As seen in FIG. 3, the peep hole 17 centrally traverses through the handle 9 and the head portion 1 and comprises a handle traversing portion 18 and a head traversing portion 19. In other words, the peep hole 17 extends along a length of the present invention through the handle 9 and the head portion 1. The handle traversing portion 18 is concentrically aligned with the head traversing portion 19 to create a continuous opening for the peep hole 17 through the handle 9 and the head portion 1. Preferably, the peep hole 17 will have a ¼-inch diameter through the handle traversing portion 18 and the head traversing portion 19 allowing the user to have an unobstructed view through the peep hole 17. However, the size and cross-sectional area of the peep hole 17 can vary in different embodiments of the present invention. As seen in FIG. 2A, to maintain the continuous opening of the peep hole 17, and not interrupt the head traversing portion 19 within the head portion 1, the lighting source 6 encircles the head traversing portion 19. As a result, the desired viewing area illuminated by the lighting source 6 and the peep hole 17 are aligned with each other. Likewise, as seen in FIG. 2B, to maintain the continuous opening of the peep hole 17, and not interrupt the handle traversing portion 18, the power source 15 is positioned within the handle 9 to encircle the handle traversing portion 18.

As mentioned earlier, the lighting source 6 and the power source 15 can vary in different embodiments of the present invention. As further illustrated in FIG. 2A, in the preferred embodiment of the present invention, a plurality of light-emitting diodes (LEDs) 7 is used as the lighting source 6 and is configured into a ring configuration. Therefore, the peep hole 17 is encircled by the plurality of LEDs 7. As further illustrated in FIG. 2B, in the preferred embodiment, a plurality of batteries 16 is used as the power source 15 and is configured into a ring configuration. Thus, the peep hole 17 is encircled by the plurality of batteries 16.

Figure 4:
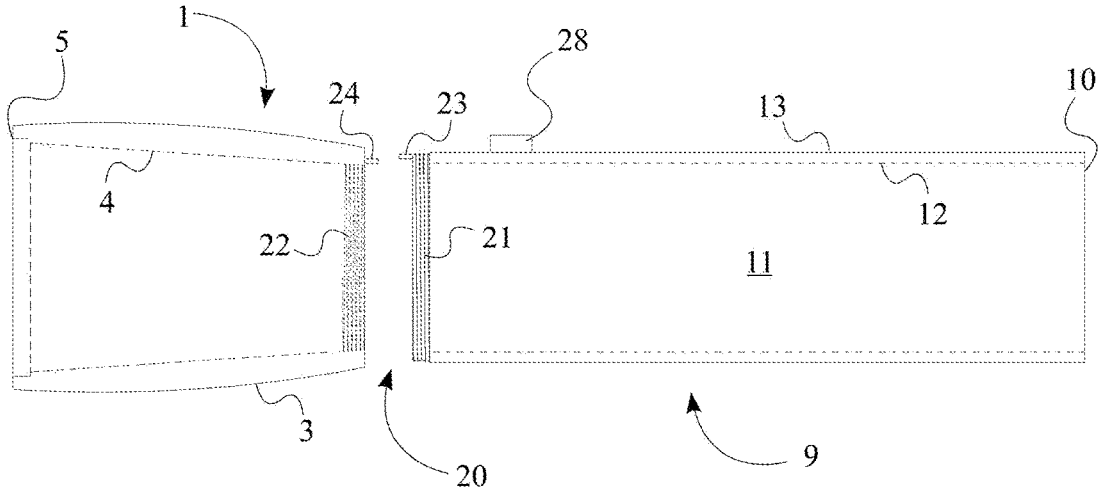
FIG. 4 is a side view of the head portion and the handle, wherein the handle is removably attached to the head portion.

Similar to a flashlight, the head portion 1 is specifically designed to maximize the light emitted from the lighting source 6. As seen in FIG. 3 and FIG. 4, the head portion 1 comprises a proximal end 2, a tapered body 3, and a distal end 5. The tapered body 3 extends from the proximal end 2 to the distal end 5 and determines an overall length of the head portion 1. Since the head traversing portion 19 needs to continue through the tapered body 3, the head traversing portion 19 extends from the proximal end 2 to the distal end 5. Even though the tapered body 3 is preferred, a different comparable shape can also be used in other embodiments of the present invention.

As further illustrated in FIG. 2A, in addition to the tapered body 3, the present invention further comprises a reflector 8 that maximizes the range of the light emitted by the lighting source 6. To effectively maximize the range, the reflector 8 is positioned adjacent the lighting source 6 and along an inner surface 4 of the tapered body 3 extending from the proximal end 2 to the distal end 5. To be positioned within the tapered body 3 the reflector 8 is also tapered.

As shown in FIG. 3 and FIG. 4, in the preferred embodiment of the present invention, the handle 9 is cylindrical and comprises a first end 10, a body 11, and a second end 14. The body 11 extends from the first end 10 to the second end 14 and determines an overall length of the handle 9. Since the handle traversing portion 18 needs to traverse through a length of the handle 9, the handle traversing portion 18 extends from the first end 10 to the second end 14. When connecting the handle 9 and the head portion 1, the connection occurs at the second end 14 of the handle 9. As a result, the handle traversing portion 18 is positioned adjacent the head traversing portion 19, completing the continuous opening of the peep hole 17. Even though the shape of the handle 9 is cylindrical in the preferred embodiment, the overall shape of the handle 9 can vary as long as the functionality of the handle 9 remains the same.

As discussed before, the power source 15 is positioned within the handle 9, encircling the handle traversing portion 18. As shown in FIG. 4, to position the power source 15 as preferred, the handle 9 further comprises an inner lateral wall 12 and an outer lateral wall 13 that are positioned opposite to each other across the body 11 of the handle 9. To position the power source 15 without hindering the handle traversing portion 18, the power source 15 is mounted against the inner lateral wall 12 encircling the handle traversing portion 18. Since the handle 9 has a cylindrical shape in the preferred embodiment, the outer lateral wall 13, the inner lateral wall 12, and the handle traversing portion 18 are all concentric to each other. Moreover, a distance between the inner lateral wall 12 and the outer lateral wall 13 determines the thickness of the body 11 of the handle 9.

As further illustrated in FIG. 4, in a different embodiment of the present invention, the handle 9 can be removably attached to the head portion 1. To allow the separation between the handle 9 and the head portion 1, the present invention further comprises a fastening mechanism 20 so that the handle 9 can be removably attached to the head portion 1 through the fastening mechanism 20 that comprises a first set of threads 21 and a second set of threads 22. The first set of threads 21 is perimetrically and externally distributed along a body 11 of the handle 9 adjacent the second end 14 of the handle 9. To correspond with the first set of threads 21, the second set of threads 22 is perimetrically and internally distributed along the tapered body 3 adjacent the proximal end 2. Thus, the second end 14 can be positioned into the proximal end 2 so that the first set of threads 21 is engaged with the second set of threads 22. The handle 9 can be separated from the head portion 1 by disengaging the first set of threads 21 from the second set of threads 22.

As discussed earlier, the power source 15 is positioned within the handle 9 and the lighting source 6 is positioned within the head portion 1. Therefore, the current flows from the power source 15 to the lighting source 6 only when the handle 9 is attached to the head portion 1. To maintain the current flow from the power source 15 to the lighting source 6, the present invention further comprises a first electrical contact 23 and a second electrical contact 24 as shown in FIG. 4. The first electrical contact 23 is terminally connected to the handle 9 at the second end 14 and is electrically connected to the power source 15. As a result, the current can be drawn from the power source 15 through the first electrical contact 23. The current drawn at the first electrical contact 23 is used by the second electrical contact 24 that is terminally connected to the head portion 1 at the proximal end 2. Moreover, the second electrical contact 24 is electronically connected to the lighting source 6. The positioning of the first electrical contact 23 and the second electrical contact 24 ensures that the current flows from the power source 15 through the first electrical contact 23, through the second electrical contact 24, and into the lighting source 6. To do so, the first electrical contact 23 and the second electrical contact 24 are electrically connected to each other. A control switch 28 which is externally mounted onto the outer lateral wall 13 can be used to control the lighting source 6 when the handle 9 is attached to the head portion 1. To do so, the control switch 28 is electronically connected to the lighting source 6 and the power source 15. In another embodiment of the present invention, the control switch 28 can be a dimmer so that the user can adjust the overall brightness of the lighting source 6 according to preference.

As seen in FIG. 2A and FIG. 2B, to protect the lighting source 6 from dust and other comparable external factors, the present invention further comprises a transparent lens 25 that is preferably mounted onto the tapered body 3 at the distal end 5 so that the peep hole 17 traverses through the transparent lens 25. To hold the transparent lens 25 stationary, the present invention further comprises a front cap 200 that is mounted onto the distal end 5 over the transparent lens 25, trapping the transparent lens 25 between the front cap 200 and the lighting source 6. To maintain the functionality of the peep hole 17, a cap opening 101 centrally traverses through the front cap 200. A diameter of the cap opening 101 is similar to a diameter of the peep hole 17. In another embodiment of the present invention, a magnifying lens can be terminally mounted onto the peep hole 17 adjacent the distal end 5. As a result, the present invention can not only be used for viewing the desired viewing area but also for magnifying the desired viewing area.

Figure 5:
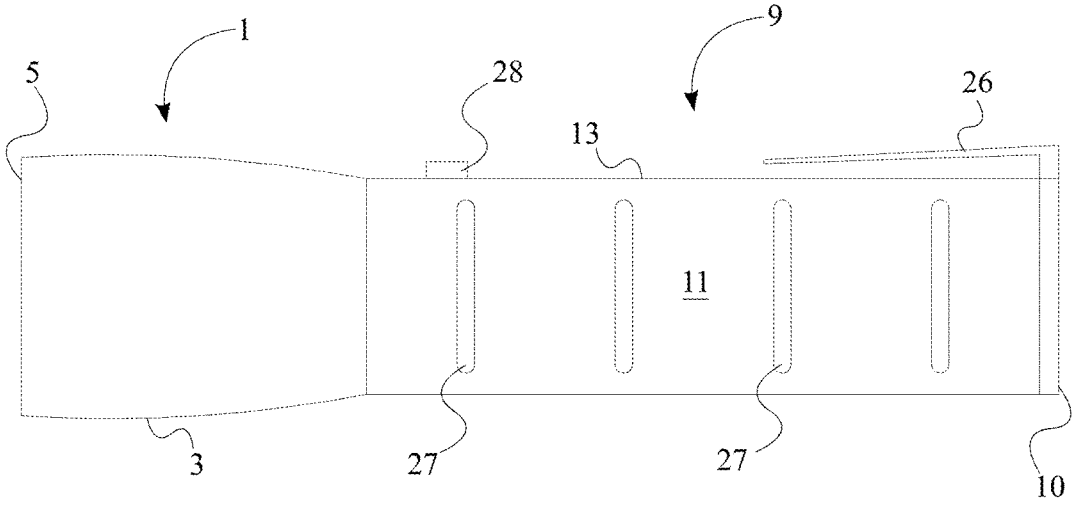
FIG. 5 is a side view of the present invention, wherein the attachment clip and the plurality of gripping protrusions are illustrated.

As seen in FIG. 5, for user convenience, the present invention further comprises an attachment clip 26 that allows the user to carry the present invention conveniently. Preferably, the attachment clip 26 will be mounted onto the outer lateral wall 13 of the handle 9 adjacent the first end 10. Therefore, the present invention can be clipped onto a pocket or similar location.

As further illustrated in FIG. 5, for added user convenience, in another embodiment, the present invention further comprises a plurality of gripping protrusions 27 that is distributed along the body 11 of the handle 9 from the first end 10 to the second end 14. The presence of the plurality of gripping protrusions 27 helps the user maintain a secure grip while utilizing the present invention.

When the present invention is being used, the following process flow is generally followed. Initially, the power source 15 is inserted into the handle 9. In the preferred embodiment of the present invention, each of the plurality of batteries 16 are positioned around the handle traversing portion 18. To secure the plurality of batteries 16 within the handle 9, an end cap 100 is mounted onto a first end 10 of the handle 9. To access the peep hole 17 through the end cap 100, a cap opening 101 would centrally traverse through the end cap 100. Moreover, the cap opening 101 will be concentrically aligned with the handle traversing portion 18. If the first set of threads 21 and the second set of threads 22 are being used, the first set of threads 21 is engaged to the second set of threads 22. When the head portion 1 and the handle 9 are connected, and the present invention is ready to be used, the distal end 5 of the head portion 1 is positioned against the opening that traverses into the desired viewing area. Next, the lighting source 6 is illuminated so that the desired viewing area is illuminated through the opening. To view the desired viewing area which is now illuminated, the user positions an eye at the first end 10 of the handle 9. Since the peep hole 17 extends from the first end 10 of the handle 9 to the distal end 5 of the head portion 1, the desired viewing area can be viewed.

Although the invention has been explained in relation to its preferred embodiment, it is to be understood that many other possible modifications and variations can be made without departing from the spirit and scope of the invention as hereinafter claimed.

What is claimed is:

1. A lighting device with a viewing hole comprising:
- a head;
- a lighting source;
- a handle;
- a power source;
- a peep hole;
- a tapered reflector;
- the handle being removably and terminally connected to the head;
- the lighting source being positioned within the head;
- the power source being positioned within the handle;
- the power source being configured to be electrically connected to the lighting source;
- the head comprising a proximal end, a tapered body and a distal end;
- the tapered body extending from the proximal end to the distal end so as to determine an overall length of the head;
- the tapered reflector being positioned along an inner surface of the tapered body;
- the tapered reflector extending from the proximal end to the distal end;
- the handle comprising a first end, a handle body, a second end and an outer lateral wall;
- the handle body extending from the first end to the second end;
- the second end being removably connected to the proximal end;
- a control switch;
- the control switch being externally mounted onto the outer lateral wall;
- the control switch being electronically connected to the lighting source and the power source;
- a first electrical contact;
- the first electrical contact being terminally connected to the second end;
- the first electrical contact being electrically connected to the power source;
- a second electrical contact;
- the second electrical contact being terminally connected to the proximal end;
- the second electrical contact being electronically connected to the lighting source;
- the first electrical contact and the second electrical contact being removably coupled with each other;
- in response to the second end being connected to the proximal end, the first electrical contact and the second electrical contact directly contacting against each other, such that the power source and the lighting source are electrically connected to each other by the first electrical contact and the second electrical contact being electrically connected to each other;

the peep hole comprising a handle traversing portion and a head traversing portion;

the handle traversing portion centrally traversing through the handle from the first end to the second end;

the head traversing portion centrally traversing though the head from the proximal end to the distal end; and in response to the second end being connected to the proximal end, the handle traversing portion being concentrically aligned with the head traversing portion, such that the handle traversing portion and the head traversing portion of the peep hole are not visually obscured by the first electrical contact and the second electrical contact.

2. The lighting device with the viewing hole as claimed in claim 1 comprising:

the lighting source being a plurality of light-emitting diodes (LED) configured into a ring configuration; and the peep hole being encircled by the plurality of light-emitting diodes.

3. The lighting device with the viewing hole as claimed in claim 1 comprising:

the power source being a plurality of batteries configured into a ring configuration; and the peep hole being encircled by the plurality of batteries.

4. The lighting device with the viewing hole as claimed in claim 1 comprising:

the tapered reflector being positioned adjacent the lighting source.

5. The lighting device with the viewing hole as claimed in claim 1 comprising:

the handle comprising an inner lateral wall;

the inner lateral wall and the outer lateral wall being oppositely positioned to each other across the handle body; and the power source being mounted against the inner lateral wall encircling the handle traversing portion.

6. The lighting device with the viewing hole as claimed in claim 1 comprising:

a fastening mechanism; and the handle being removably attached to the head through the fastening mechanism.

7. The lighting device with the viewing hole as claimed in claim 6 comprising:

the fastening mechanism comprising a first set of threads and a second set of threads;

the first set of threads being perimetrically and externally distributed along the handle body adjacent the second end;

the second set of threads being perimetrically and internally distributed along the tapered body adjacent the proximal end; and the first set of threads being removably engaged with the second set of threads.

8. The lighting device with the viewing hole as claimed in claim 1 comprising:

a transparent lens; and the transparent lens being mounted onto the tapered body at the distal end.

9. The lighting device with the viewing hole as claimed in claim 1 comprising:

an attachment clip; and the attachment clip being mounted onto the handle body adjacent to the first end.

10. The lighting device with the viewing hole as claimed in claim 1 comprising:

a plurality of gripping protrusions; and the plurality of gripping protrusions being distributed along the handle body from the first end to the second end.

11. The lighting device with the viewing hole as claimed in claim 1 comprising:

a front cap;

a front cap opening;

the front cap opening centrally traversing through the front cap; and the front cap being mounted onto the distal end.

12. The lighting device with the viewing hole as claimed in claim 1 comprising:

an end cap;

an end cap opening;

the end cap opening centrally traversing through the end cap; and the end cap being mounted onto the first end.

* * * * *